US006488558B1

(12) United States Patent
Scrivner

(10) Patent No.: US 6,488,558 B1
(45) Date of Patent: Dec. 3, 2002

(54) VEHICLE NOISEMAKER

(76) Inventor: Tommy E. Scrivner, 3144 S. 68 Plz., Omaha, NE (US) 68106-3637

( * ) Notice: Subject to any disclaimer, the term of this patent is extended or adjusted under 35 U.S.C. 154(b) by 0 days.

(21) Appl. No.: 09/985,899

(22) Filed: Nov. 6, 2001

(51) Int. Cl.[7] ..... A63H 33/00
(52) U.S. Cl. ..... 446/267; 446/404
(58) Field of Search ..... 446/397, 404, 446/409, 213, 175, 267

(56) References Cited

U.S. PATENT DOCUMENTS

| | | | | |
|---|---|---|---|---|
| 3,747,233 A | | 7/1973 | Berryman | |
| 3,777,310 A | | 12/1973 | Yang | |
| 4,270,764 A | | 6/1981 | Yamada | |
| 4,744,356 A | * | 5/1988 | Greenwood | 128/204.23 |
| 4,917,645 A | | 4/1990 | Amici et al. | |
| 5,791,967 A | * | 8/1998 | Yeh | 446/279 |
| 6,055,910 A | | 5/2000 | Zanakis et al. | |

OTHER PUBLICATIONS

Fart Machine; available on website: http://www.speaktomecatalog.com (under Obnoxious topic) (1 page).
Fume Man; available on website: http://www.speaktomecatalog.com (under Obnoxious topic) (1 page).
Pull My Finger Fred; available on website: http://www.speaktomecatalog.com (under Obnoxious topic) (1 page).

* cited by examiner

*Primary Examiner*—Jacob K. Ackun
(74) *Attorney, Agent, or Firm*—Henderson & Sturm LLP

(57) ABSTRACT

A vehicle noisemaker device and method are provided according to the invention. The vehicle noisemaker device includes a gas supply configured to be removably affixed to a vehicle, with the gas supply including at least one gas supply outlet. The vehicle noisemaker device further includes at least one nozzle. The at least one nozzle creates a flatulation sound effect. An at least one outlet valve is positioned between and communicates with the at least one gas supply outlet and the at least one nozzle for allowing the gas to be released from the gas storage tank. The vehicle noisemaker device preferably also includes a controller communicating with the at least one outlet valve and controlling a release of the gas from the gas storage tank. The controller is preferably manually triggered and opens the at least one outlet valve to create the flatulation sound effect.

46 Claims, 4 Drawing Sheets

VEHICLE NOISEMAKER

BACKGROUND OF THE INVENTION

1. Field of the Invention

The present invention relates generally to a vehicle noisemaker, and more particularly to a vehicle noisemaker that produces a flatulation sound effect.

2. Description of the Background Art

Novelty noisemakers have been around for some time. Their purpose generally is to amuse and entertain, and sometimes to embarrass. One example is a device that simulates flatulence. Flatulence is a human bodily function that is natural but yet is widely considered impolite. Therefore, it may be used in order to embarrass and entertain. In addition it may be used to show disdain or disrespect.

In the prior art, the typical noisemaker associated with a vehicle is a car horn. The car horn is intended to be a warning device or a safety device. A car horn therefore is perceived as serious and not light-hearted. If the driver or occupant of a vehicle wants to generate a sound effect that is not serious or sober, generally his or her options are fairly limited.

What is needed, therefore, are improvements in vehicle noisemaker devices.

SUMMARY OF THE INVENTION

A vehicle noisemaker device is provided according to one embodiment of the invention. The vehicle noisemaker device comprises a gas supply configured to be removably affixed to a vehicle, with the gas supply including at least one gas supply outlet. The vehicle noisemaker device further comprises at least one nozzle. The at least one nozzle creates a flatulation sound effect. An at least one outlet valve is positioned between and communicates with the at least one gas supply outlet and the at least one nozzle for allowing the gas to be released from the gas storage tank. The vehicle noisemaker device preferably also includes a controller communicating with the at least one outlet valve and controlling a release of the gas from the gas storage tank. The controller is preferably manually triggered and opens the at least one outlet valve to create the flatulation sound effect.

A method of creating a flatulation sound effect in association with a vehicle is provided according to one embodiment of the invention. The method includes a step of providing a gas supply capable of being removably attached to the vehicle. The gas supply may include at least one gas supply outlet. The method further includes the steps of attaching the gas supply to the vehicle and opening at least one outlet valve communicating with the at least one gas supply outlet to release the gas. The method further includes the step of discharging the gas through at least one nozzle communicating with the at least one outlet valve. The gas passing through the at least one nozzle creates the flatulation sound effect.

The above and other features and advantages of the present invention will be further understood from the following description of the preferred embodiments thereof, taken in conjunction with the accompanying drawings.

DETAILED DESCRIPTION OF THE PREFERRED EMBODIMENTS

Figure 1:
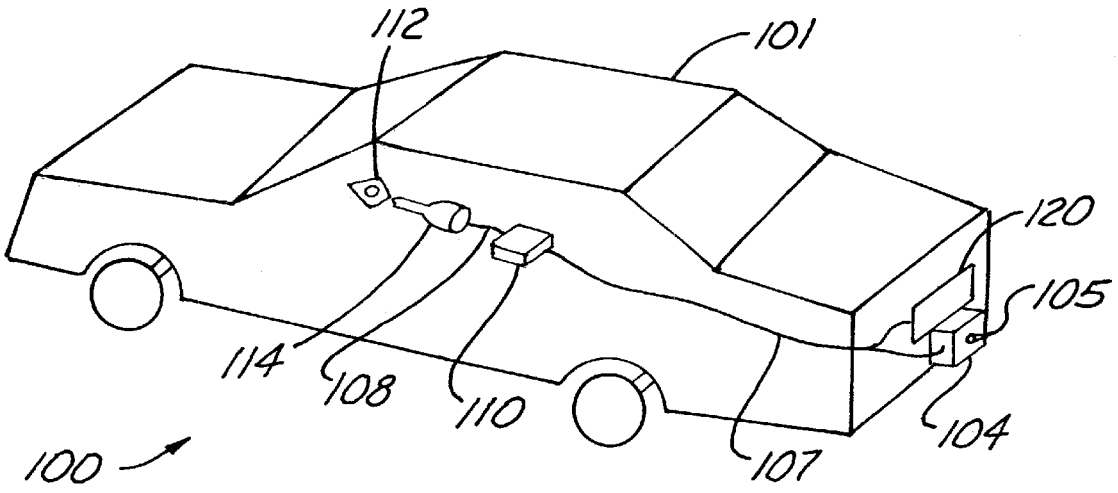
FIG. 1 shows a vehicle noisemaker device according to a first embodiment of the invention mounted on a vehicle.

FIG. 1 shows a vehicle noisemaker device 100 according to a first embodiment of the invention. The vehicle noisemaker device 100 includes a gas storage tank 104, a nozzle 105, a controller 110, and at least one link 107 connecting the gas storage tank 104 to the controller 110. The controller 110 is further connected to a cigarette lighter plug 114 by at least one wire 108.

The gas storage tank 104 may be any type of tank or storage device capable of containing a gas, including a storage device capable of containing a gas under pressure.

The gas storage tank 104 may therefore be formed of metal, fiberglass, etc. In addition, the gas storage tank 104 may be formed of a flexible and/or stretchable material, such as rubber, for example, that enables the gas storage tank 104 to operate as a bladder or diaphragm. The gas introduced into the gas storage tank 104 is preferably air, but may comprise other gases, such as compressed carbon dioxide or nitrogen. Alternatively, the gas may be produced by storing a liquid gas under pressure, with the flatulation sound effect being produced by gas that boils off of the liquid gas. In another alternative embodiment, the gas storage tank 104 may store two or more liquids that produce a gas when they are combined. This embodiment would require valves that control the mixing of the liquids, and may optionally include a valve for controlling the release of the gas thus produced (in one embodiment the gas may escape through the nozzle without need of a regulating valve).

The nozzle 105 oscillates during a gas discharge to produce a sound that simulates flatulation. The nozzle 105 may be formed of any suitable cross-sectional shape and dimension capable of producing a flatulation sound effect. The cross-sectional area may be of a predetermined size that provides a desired flatulation sound effect, including a desired frequency and volume. For example, the nozzle 105 could have an elongate tubular configuration like the nozzle on a whoopee cushion. Likewise, the nozzle material may be chosen to produce the desired flatulation sound effect. One such nozzle material may be a flexible rubber.

The gas storage tank 104 and nozzle 105 may be of a size to not only be convenient and unobtrusive but may be of a size to control the volume of the flatulation sound effect thus produced. For example the volume of the gas storage tank 104 and the cross sectional area of the nozzle 105 may be increased so that the flatulation sound effect produced therefrom is audible when emanating from the vehicle 101. The nozzle 105 can be constructed of a size and shape to produce a maximum level of sound corresponding to the gas pressure in the gas storage tank 104.

One of the novel features of this invention is that it can produce a louder flatulation noise than the noisemakers on the market. There are two reasons why the disclosed flatulation device will produce a louder sound. The first reason is that the gas storage tank 104 will hold more gas pressure than those already on the market. An example is the whoopee cushion which is blown up by human breath and will not hold more gas pressure than can be produced by a person. The second reason is that the nozzle 105 is structured much larger than those already on the market, such as the nozzle on the whoopee cushion, and is structured in size and shape to produce a maximum noise level by employing the high pressure in the gas storage tank 104.

Multiple nozzles 105 may be included in the vehicle noisemaker device 100, with each nozzle being formed to produce a unique flatulation sound effect, activated simultaneously or individually. In addition, the gas storage tank 104 may store gas at any desired pressure.

The at least one link 107 may comprise one or more wires in a bundle or may comprise a cable. The at least one link 107 may communicate one or more activation commands from the controller 110 to the gas storage tank 104, and may additionally communicate electrical power. The one or more activation commands may include activation commands that control the frequency, volume, and duration of the flatulation sound effect. The at least one link 107 is preferably formed of copper or other metals, but may additionally be an optical communication medium, such as an optical fiber.

Figure 2:
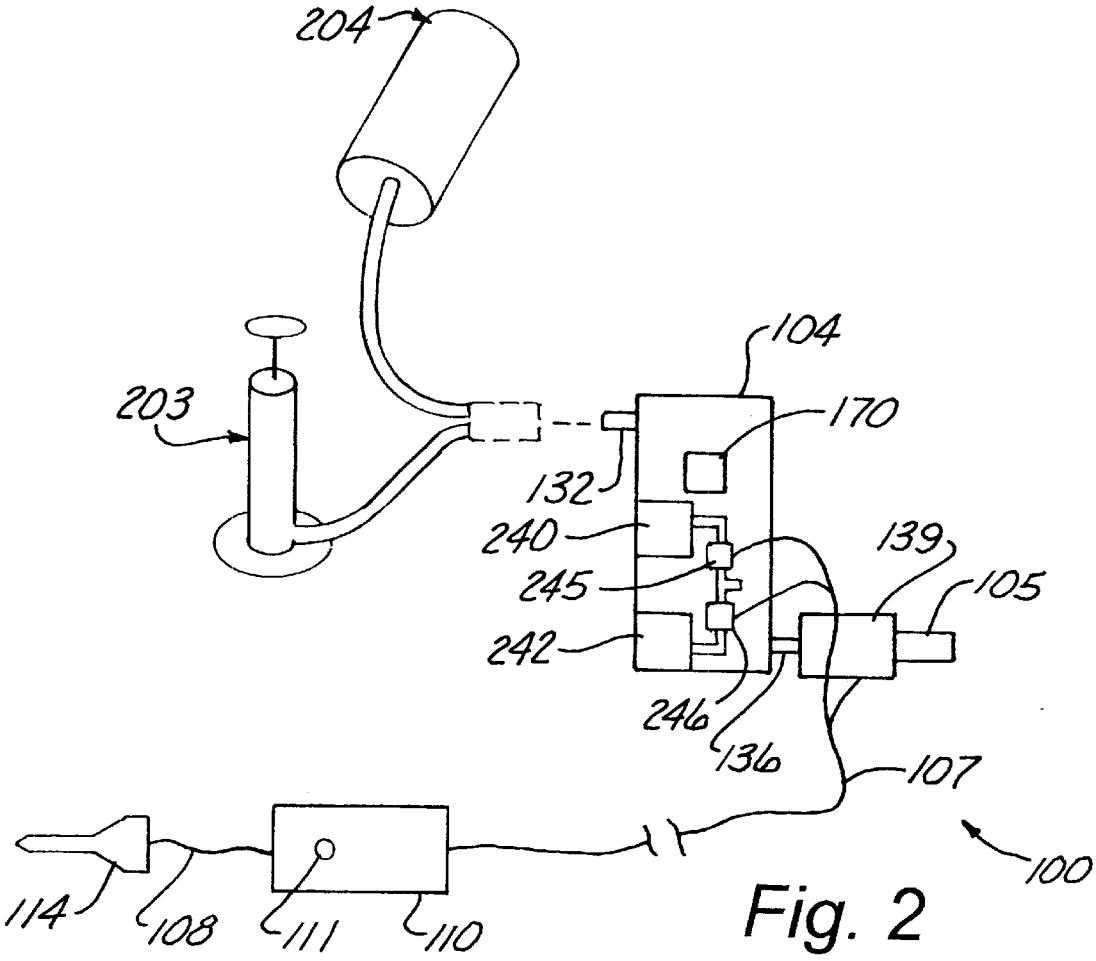
FIG. 2 shows detail of the vehicle noisemaker device of FIG. 1.

Referring now to FIG. 2, the controller 110 includes a button or other activation device 111 that the driver or vehicle occupant may use to activate the vehicle noisemaker device 100. The button 111 may be a switch, input selector, dial, etc., that accepts user inputs and converts the user inputs into electrical signals. In its simplest form, the controller 110 may include a normally open circuit that transforms power from the cigarette lighter receptacle 112 (or some other power source) into an electrical signal suitable for operating the valve 139 when the switch is closed. The controller 110 may optionally include a processor and memory that may be used, for example, to interpret a switch or button closure, debounce the switch, and select from among a set of predetermined flatulation sound effect characteristics. A processor could therefore be used to store characteristics such as duration, frequency, pressure, pressure variations, etc., in order to present a variety of flatulation sound effects to the user. The controller 110 therefore may optionally include user input devices that control the frequency, volume, and duration of the flatulation sound effect. The vehicle occupant may thereby activate a gas discharge through the nozzle 105 in order to create a flatulation sound effect of a desired duration.

The at least one wire 108 provides electrical power from the cigarette lighter plug 114 (i.e., from the vehicle electrical system) to the controller 110. Only one wire may be necessary if the gas storage tank 104 is electrically grounded to the vehicle 101.

The cigarette lighter plug 114 may be any size or type of cigarette lighter plug 114 that plugs into a vehicle cigarette lighter receptacle 112, for example, as shown in FIG. 1. A device to pass power from the cigarette lighter receptacle 112 to the gas storage tank 104 may be a device such as a Safco No. 30 TRP, triple outlet plug-in, or Safco's No. 6 plug with extension cord 108,107, all of which may be obtained from Safco Corp., 6060 Northwest Hwy., Chicago, Ill., 60631, phone (312) 631-6216. The cigarette lighter plug 114 therefore allows the vehicle noisemaker device 100 to be powered by the electrical system of the vehicle 101, eliminating need for a power source, such as batteries, etc. The U.S. Pat. No. 4,988,315 to Wharton discloses a device similar to the cigarette lighter plug 114, and is incorporated herein by reference.

Referring again to FIG. 1, the vehicle noisemaker device may optionally include at least one display 120 that may be used to display a text message (or other visual message). The message on the display 120 may be related to the flatulation sound effect emitted from the nozzle 105. The purpose of the display 120 is. to do more than just entertain. In heavy traffic a driver may hear many loud noises, and it would be easy to mistake the flatulation sound effect as being some other kind of noise. But with the display 120, the observer is preconditioned to expect a flatulation sound effect. The observer is unlikely to think of the sound as being anything other than a flatulation sound effect.

The display 120 is preferably part of or is attached to the gas storage tank 104, but may be separate from and individually attached to the vehicle. The display 120 may communicate with the controller 110 via the at least one wire 107. The display 120 can put out one or more messages which can be chosen by the user through the controller 110.

The display 120 may be used in conjunction with the flatulation sound effect. For example, the display 120 may contain a visual message composed of text and/or graphics that warn nearby persons that the flatulation sound effect is about to be produced. The visual message may be displayed substantially concurrent with an activation of the nozzle 105 to produce the flatulation sound effect, or may be displayed before or after the flatulation sound effect. However, it is preferred that the visual message be displayed before the flatulation sound effect occurs. In addition, the display 120 may include personalized text or information regarding the origin or manufacture of the vehicle noisemaker device 100. The display 120 can point out the nozzle 105 and the gas discharge tank 104 as the flatulation device to precondition the observer's mind. The display 120 can optionally include a phone number or manufacturer's information so that the observer can order his or her own vehicle noisemaker device 100.

The display 120 may include light emitting diodes (LEDs), a liquid crystal display (LCD), fluorescent elements, incandescent elements, etc. The display 120 may be connected to the controller 110 with one or more wires, including by the link 107 or by a separate wire or wire harness. This may also include a wireless link as discussed below in conjunction with FIGS. 3 and 4. In a preferred embodiment, the display 120 lights up to make the display 120 more immediately noticeable to the observer. The visual message may be chosen by the user by employing the controller 110 in much the same manner as using a TV remote to choose a channel. Alternatively, a constant, non-changing display 120 may be used without departing from the spirit of the invention.

In use, the gas discharge tank 104 and nozzle 105 may be placed anywhere on or in the vehicle 101. A preferred location may be on the rear portion of the vehicle 101. One reason for putting the gas storage tank 104 on the rear portion of the vehicle 101 is for the comical reason that this is in reference to the rear end of a human being. This is especially true when the display 120 points out the nozzle 105 and the gas discharge tank 104 as the flatulation device. The controller 110 is preferably located in an occupant compartment of the vehicle 101. The controller 110 may be manipulated by a user to activate the vehicle noisemaker device 100, which produces a flatulation sound effect. The flatulation sound effect is produced from the nozzle 105 as a result of a gas discharge from the gas storage tank 104.

Although a passenger car is shown in the figure, it should be understood that the vehicle 101 may be any type of vehicle, such as a van, truck, pickup truck, sport utility vehicle, bus, construction or farm equipment, recreational vehicle, boat, motorcycle, etc.

FIG. 2 shows detail of the vehicle noisemaker device 100. As can be seen from this figure, the gas storage tank 104 includes an optional tank inlet 132, a tank outlet 136, an outlet valve 139, and an attachment device 170.

The optional tank inlet 132 allows gas to be introduced into the gas storage tank 104. Several different sources of gas may be used to introduce gas, such as a hand pump 203 or a storage cylinder 204, for example. In addition, a vehicle gas supply may be employed to fill the gas storage tank 104, such as a vehicle air compressor. Alternatively, a gas can be introduced by a pump or compressor and a motor, such as the "1291 air horn kit," available from Grover Products Co., 3424 East Olympic Blvd., Los Angeles, Calif., 90023, phone (213) 263-9981. The "1291 air horn kit" produces air pressure for vehicle horns, and could relieve the user of the burden of manually filling the gas storage tank 104.

In one embodiment, the gas storage tank 104 does not include a tank inlet 132, and the gas storage tank 104 is disposable. This may include commercially available gas canisters, such as a $CO_2$ canister commonly used for inflating various devices.

The tank outlet 136 is a conduit for releasing the gas. The tank outlet 136 communicates with the outlet valve 139.

The outlet valve 139 is positioned between and communicates with the tank outlet 136 and the nozzle 105. The outlet valve 139 regulates passage of gas through the nozzle 105 and may be used to initiate, regulate, and terminate a flatulation sound effect due to release of the gas. The outlet valve 139 may be any type of valve capable of regulating a gas flow, and is preferably an electrically activated valve, such as a solenoid-activated valve. In a first outlet valve embodiment, the outlet valve 139 may be capable only of an open position and a closed position. Therefore, the outlet valve 139 may be capable of only regulating the duration of the flatulation sound effect. The frequency and volume of the flatulation sound effect may be determined by other parameters of the vehicle noisemaker device 100, such as the characteristics of the nozzle 105. In a second outlet valve embodiment, the outlet valve 139 may be capable of a range of open positions and may control the frequency, volume, and duration of the flatulation sound effect. If the device 100 includes more than one nozzle 105, an outlet valve can be provided between the gas storage tank 104 and each of the nozzles 105.

The gas storage tank 104 further includes an attachment device 170 that may be used to removably attach the gas storage tank to any desired location on the vehicle 101. Multiple attachment devices 170 may be used, including attachment devices 170 on both the gas storage tank 104 and on the controller 110. In addition, the display 120 may include an attachment device 170 if the display 120 is not an integral part of the gas storage tank 104.

A desired location for removably attaching the gas storage tank 104 may include for example a trunk, rear tailgate or rear bumper portion of the vehicle. Alternatively the gas storage tank 104 may be attached to some underside region of the vehicle. The attachment device 170 may include a hook or hooks which may for example be closed into the trunk lid or door or tailgate of the vehicle, one or more strips of material having a knob at an end, with the strip being closed in the trunk or door, one or more magnets, an adhesive foam or adhesive tape, or a hook and loop type fastener (i.e., VELCRO).

FIG. 2 also shows an optional, alternate gas supply configuration that includes an optional first liquid storage 240 and second liquid storage 242. These two optional components may contain liquids that generate a gas when mixed. The valves 245 and 246 control the mixing of the liquids. The gas output produced after the valves 245 and 246 may be vented into the gas storage tank 104, as shown, or may directly supply the gas to the nozzle 105 (with or without the outlet valve 139).

Figure 3:
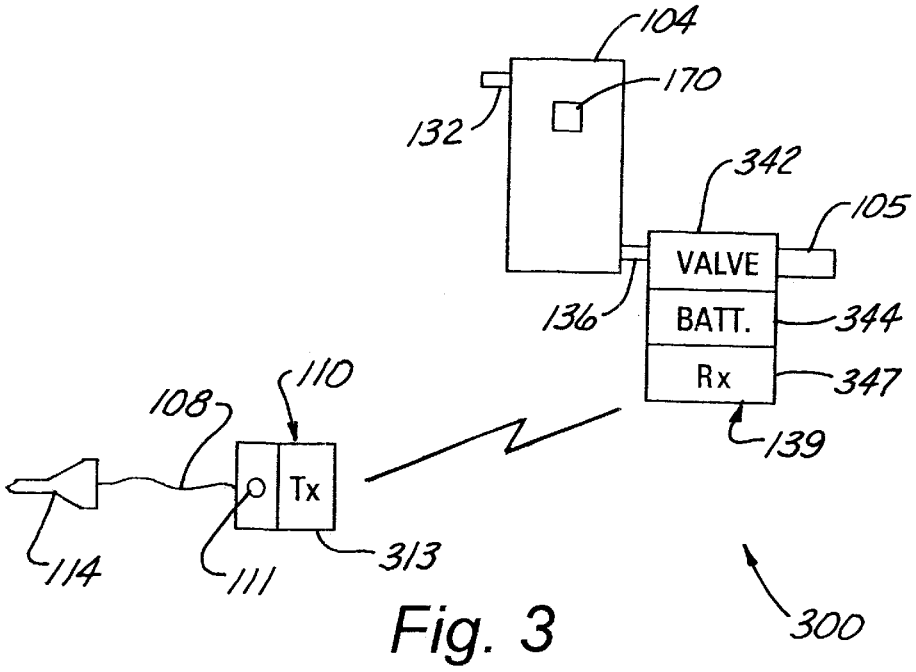
FIG. 3 shows a vehicle noisemaker device according to a second embodiment of the invention.

FIG. 3 shows a vehicle noisemaker device 300 according to a second embodiment of the invention. It should be noted that the features common to all of the embodiments share common reference numerals. In addition, the controller 110 may also include a battery (not shown). When the cigarette lighter plug 114 is not plugged into the vehicle cigarette lighter receptacle 112, the device may obtain electrical power from the battery.

In the second embodiment the at least one link 107 is replaced by a wireless link. The wireless link includes a transmitter 313 in the controller 110. The wireless link further includes a receiver 347, a battery 344 (or other power source), and a valve component 342 in the outlet valve 139. The outlet valve 139 requires a battery 344 or other power source to power the receiver 347 and to activate the valve component 342. The advantage of this embodiment is that there is no need to run a wire from the passenger compartment to the location of the gas storage tank 104.

The wireless link is preferably a radio frequency communications link such as is known in the art, but alternatively may be an infrared or ultrasonic link. The wireless link can be a low power, unlicensed wireless link having a limited range.

Figure 4:
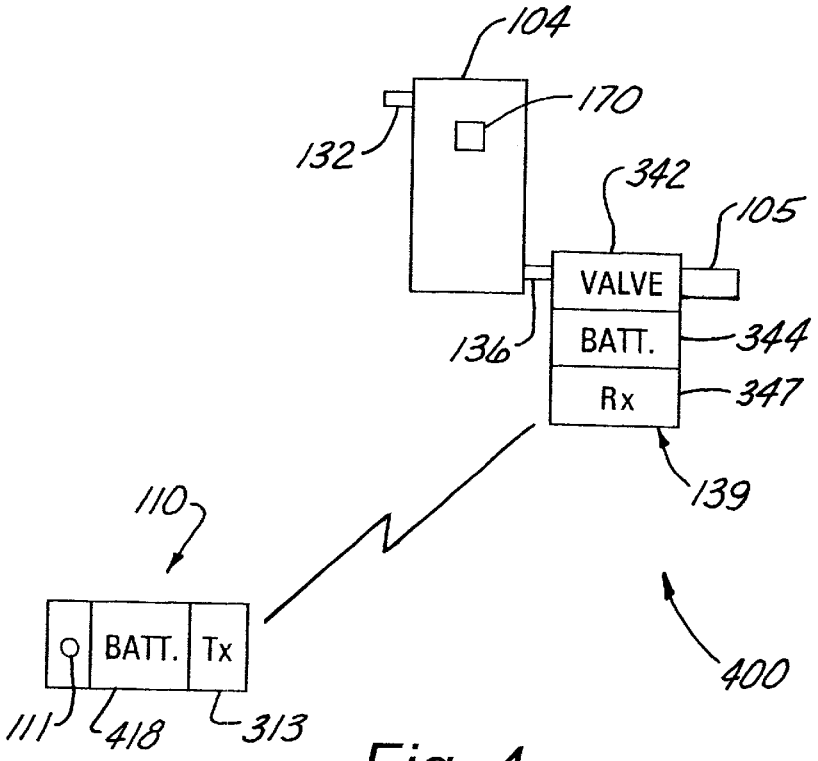
FIG. 4 shows a vehicle noisemaker device according to a third embodiment of the invention.

FIG. 4 shows a vehicle noisemaker device 400 according to a third embodiment of the invention. It should be noted that the features common to all of the embodiments share common reference numerals.

In the third embodiment 400, the wires 108 and cigarette lighter plug 114 are replaced by an internal power source 418 for the controller 110, such as a battery 418. As in the second embodiment 300, the transmitter 313 and receiver 347 form a wireless communication link between the controller 110 and the outlet valve 139. However, in this embodiment the user of the vehicle noisemaker device 400 may use the controller 110 inside or outside the vehicle 101 to remotely and wirelessly activate the gas storage tank 104 and nozzle 105. Alternatively, the outlet valve 139 may be triggered by a motion detection device, such as an ultrasonic or infrared motion detector device, without any user intervention.

In either the vehicle noisemaker device 300 or 400, if a display 120 (see FIG. 1) is included, it may include a battery. Alternatively, the display 120 may be powered by the battery 344.

Figure 5:
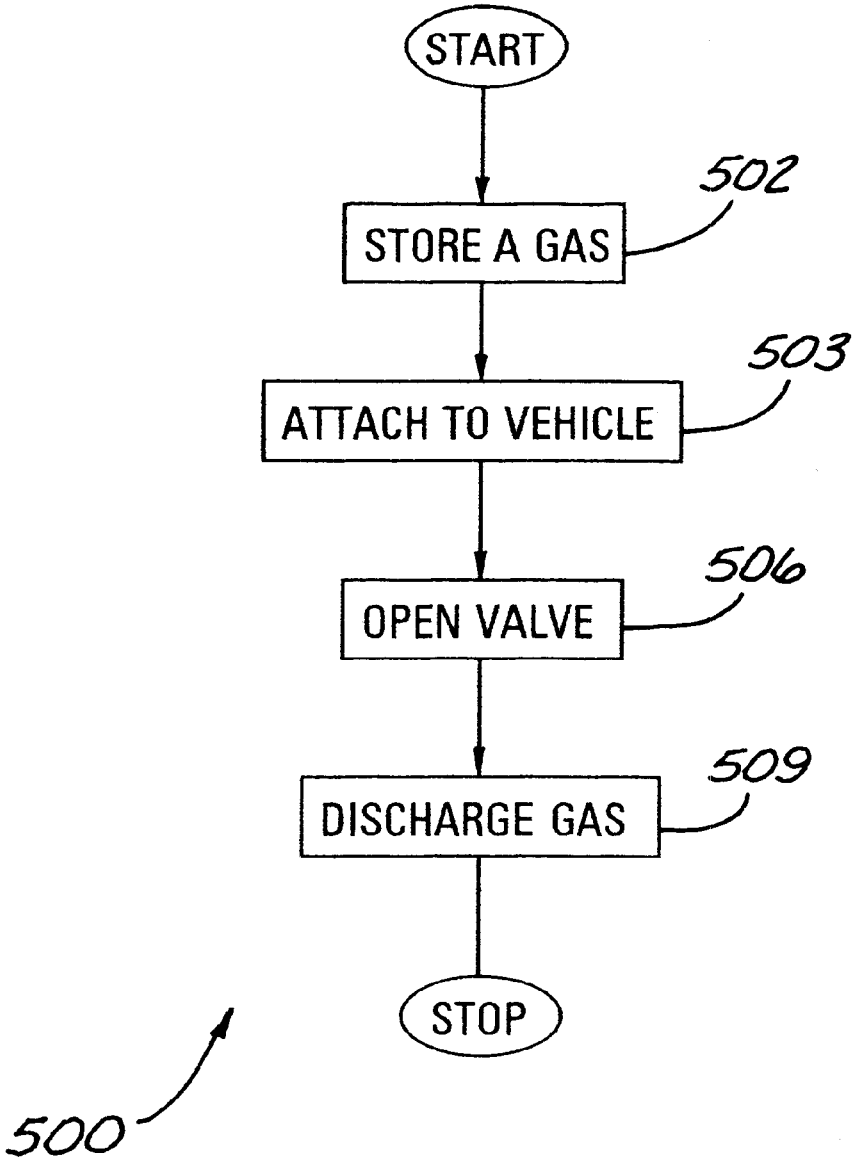
FIG. 5 is a flow chart of a vehicle noisemaker method embodiment according to the invention.

FIG. 5 is a flow chart 500 of a vehicle noisemaker method embodiment according to the invention. In step 502, gas is stored in a gas storage tank 104 capable of being removably attached to the vehicle 101. The gas storage tank 104 includes a tank outlet 136 and nozzle 105 for releasing the gas to create a flatulation sound effect. As previously discussed, the gas storage tank 104 may store and provide the gas in a variety of ways, including storing a compressed gas or storing one or more liquids that may be used to produce a gas. The gas may be supplied to the gas storage tank 104 from the vehicle 101 or may be supplied from an external gas source.

In step 503, the vehicle noisemaker device 100 according to any embodiment of the invention is attached to the vehicle 101. The vehicle noisemaker device 100 may be removably or permanently attached. It should be noted that the attaching step 503 may be done before or after the gas storing step 502.

In step 506, an outlet valve 139 communicating with the gas storage tank 104 is opened to release gas. This may be done in response to a user command. The outlet valve 139 is preferably remotely activated and is preferably electronically activated. The activation may include a controller 110 communicating with the outlet valve 139 via at least one wire 107, with the outlet valve 139 being activated by an electronic device, such as a solenoid, for example. Alternatively, the controller 110 may communicate with and activate the outlet valve 139 in a wireless fashion. Preferably this includes wirelessly communicating one or more activation commands from the controller 110 to the outlet valve 139.

In step 509, gas in the gas storage tank is released or discharged through a nozzle 105 communicating with the outlet valve 139. The nozzle 105 produces a sound effect such as a flatulation sound effect. The nozzle 105 is therefore preferably made of a flexible material, such as rubber, for example. The nozzle 105 oscillates and creates a vibration that simulates flatulation and creates a flatulation sound effect. In addition, the display 120 may display a visual message, with the visual message occurring at any time before, during, or after the flatulation sound effect. If the visual message is displayed before the flatulation sound effect and before hearing the sound, the observer is preconditioned to expect the flatulation sound effect. This is done so that an observer will be unlikely to mistake the sound as being anything but a flatulation sound.

Figure 6:
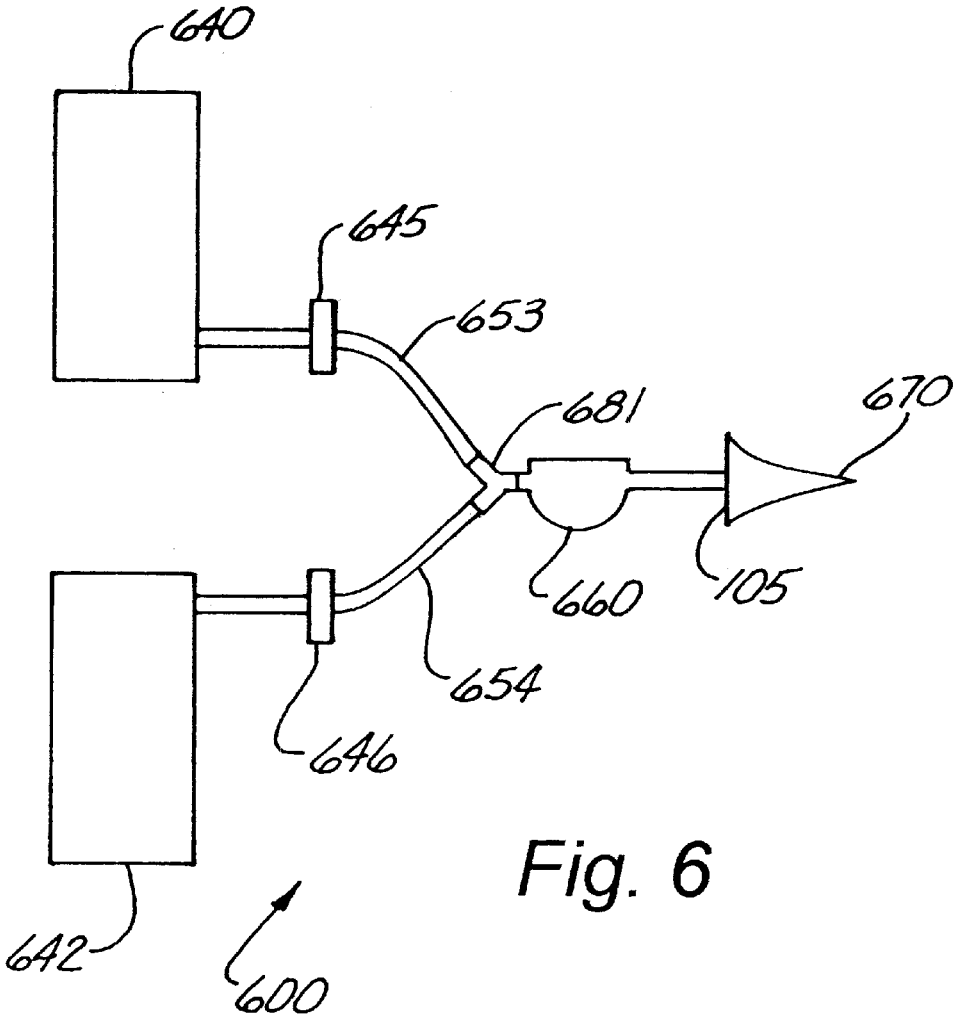
FIG. 6 shows a vehicle noisemaker device according to another embodiment of the invention.

FIG. 6 shows a vehicle noisemaker device 600 according to another embodiment of the invention. The vehicle noisemaker device 600 includes two liquid chambers 640 and 642, two liquid valves 645 and 646, two conduits 653 and 654, a junction 681, an optional mixing chamber 660, and a nozzle 105 including a nozzle end 670.

In use, the two liquid chambers 640 and 642 may store two liquids that produce a gas when combined. The two liquid valves 645 and 646 may be opened to dispense a quantity of the two fluids into the mixing chamber 660. The two liquid valves 645 and 646 may be controlled as previously discussed. The gas is produced in the mixing chamber 660 and passes through the nozzle 105 to escape, producing the flatulation sound effect. Alternatively, the mixing chamber 660 may be omitted, and the mixing may occur at the junction 681.

In this embodiment, no release valve is required, and the two liquids may be chosen so that a large volume of gas is produced as a result of the combination of the two liquids. In addition, the nozzle 105 may include a nozzle end 670 that requires a predetermined amount of gas pressure before the nozzle end 670 opens. The nozzle end 670 may include an opening pressure that is high enough to require some force to open it, thereby performing some automatic pressure regulation in the nozzle 105. A gas force will build up to that pressure before any gas will leave the nozzle 105.

Figure 7:
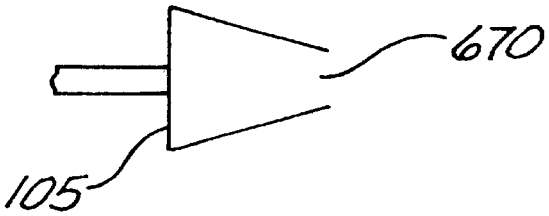
FIG. 7 shows the nozzle 105 when gas is being discharged.

FIG. 7 shows the nozzle 105 when gas is being discharged. As a result, the end 670 is opened due to the gas pressure.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A vehicle noisemaker device, comprising:

a gas supply configured to be removably affixed to a vehicle, with said gas supply including at least one gas supply outlet;

at least one nozzle communicating with said at least one gas supply outlet and configured to create a flatulation sound effect in response to a gas flow therethrough; and.

at least one outlet valve for allowing said gas to be released from said gas supply, with said at least one outlet valve being positioned between and communicating with said at least one gas supply outlet and said at least one nozzle.

2. The vehicle noisemaker device of claim 1, wherein said gas supply comprises a gas storage tank including at least one gas supply outlet for releasing said gas.

3. The vehicle noisemaker device of claim 1, further comprising a controller communicating with said at least one outlet valve and controlling release of said gas from said gas supply.

4. The vehicle noisemaker device of claim 1, further comprising a controller communicating with said at least one outlet valve and controlling release of said gas from said gas supply and said controller is manually triggered and opens said outlet valve to create a flatulation sound effect.

5. The vehicle noisemaker device of claim 1, wherein said gas supply comprises a gas storage tank and further comprising a tank inlet for supplying a gas to said gas storage tank and said gas supply communicating with said tank inlet and supplying said gas to said gas storage tank.

6. The vehicle noisemaker device of claim 1, wherein said gas supply is a pump.

7. The vehicle noisemaker device of claim 1, wherein said gas supply further comprises at least two liquid storages and said at least one outlet valve comprises at least two associated liquid combining valves within said gas supply, with said at least two liquid storages storing liquids capable of generating said gas when combined using said at least two liquid combining valves.

8. The vehicle noisemaker device of claim 1, with said vehicle noisemaker device further including a hook attachment device that may be employed to removably attach said vehicle noisemaker device to said vehicle.

9. The vehicle noisemaker device of claim 1, with said vehicle noisemaker device further including an adhesive attachment device that may be employed to removably attach said vehicle noisemaker device to said vehicle.

10. The vehicle noisemaker device of claim 1, with said vehicle noisemaker device further. including a magnetic attachment device that may be employed to removably attach said vehicle noisemaker device to said vehicle.

11. The vehicle noisemaker device of claim 1, with said vehicle noisemaker device further including a hook and loop fastener attachment device that may be employed to removably attach said vehicle noisemaker device to said vehicle.

12. The vehicle noisemaker device of claim 1, further including a display and wherein said controller controls said display to display a visual message.

13. The vehicle noisemaker device of claim 1, further including a display and wherein said controller controls said display to display a visual message substantially concurrent with an activation of said outlet valve.

14. The vehicle noisemaker device of claim 1, further including a constant, non-changing display.

15. The vehicle noisemaker device of claim 1, wherein said outlet valve and said controller are powered by an electrical system of said vehicle.

16. The vehicle noisemaker device of claim 1, wherein said outlet valve and said controller are powered by an electrical system of said vehicle and wherein said controller plugs into a vehicle cigarette lighter receptacle.

17. The vehicle noisemaker device of claim 1, wherein said controller communicates with said outlet valve over at least one interconnecting wire.

18. The vehicle noisemaker device of claim 1, wherein said outlet valve and said controller are powered by an electrical system of said vehicle and wherein said controller communicates with said outlet valve over at least one interconnecting wire.

19. The vehicle noisemaker device of claim 1, wherein said controller is powered by an electrical system of said vehicle and said controller communicates with said outlet valve over a wireless communication link, and wherein said controller comprises a wireless transmitter and said outlet valve comprises a wireless receiver.

20. The vehicle noisemaker device of claim 1, wherein said controller communicates with said outlet valve over a wireless communication link, and wherein said controller comprises a wireless transmitter and said outlet valve comprises a wireless receiver.

21. A vehicle noisemaker device, comprising:

two liquid chambers configured to be removably affixed to a vehicle, with said two liquid chambers capable of storing two liquids that produce a gas when combined;

two liquid valves attached to said two liquid chambers respectively and capable of regulating dispensation of said two liquids; and a nozzle communicating with said two liquid valves and configured to create a flatulation sound effect in response to a gas flow therethrough.

22. The vehicle noisemaker device of claim 21, further comprising a mixing chamber positioned between and communicating with said two liquid valves and said nozzle, said mixing chamber being capable of receiving said two liquids when dispensed from said two liquid chambers, with said two liquids forming a gas when combined in said mixing chamber.

23. The vehicle noisemaker device of claim 21, further comprising a controller communicating with said two liquid valves and capable of controlling release of said two liquids from said two liquid chambers.

24. The vehicle noisemaker device of claim 21, with said vehicle noisemaker device further including a hook attachment device that may be employed to removably attach said vehicle noisemaker device to said vehicle.

25. The vehicle noisemaker device of claim 21, with said vehicle noisemaker device further including an adhesive attachment device that may be employed to removably attach said vehicle noisemaker device to said vehicle.

26. The vehicle noisemaker device of claim 21, with said vehicle noisemaker device further including a magnetic attachment device that may be employed to removably attach said vehicle noisemaker device to said vehicle.

27. The vehicle noisemaker device of claim 21, with said vehicle noisemaker device further including a hook and loop fastener attachment device that may be employed to removably attach said vehicle noisemaker device to said vehicle.

28. The vehicle noisemaker device of claim 21, further including a display and wherein said controller controls said display to display a visual message.

29. The vehicle noisemaker device of claim 21, further including a display and wherein said controller controls said display to display a visual message substantially concurrent with an activation of said two liquid valves.

30. The vehicle noisemaker device of claim 21, further including a constant, non-changing display.

31. The vehicle noisemaker device of claim 21, wherein said two liquid valves and said controller are powered by an electrical system of said vehicle.

32. The vehicle noisemaker device of claim 21, wherein said controller communicates with said two liquid valves over at least one interconnecting wire.

33. The vehicle noisemaker device of claim 21, wherein said controller is powered by an electrical system of said vehicle and said controller communicates with said two liquid valves over a wireless communication link, and wherein said controller comprises a wireless transmitter and said two liquid valves comprise wireless receivers.

34. A method of creating a flatulation sound effect in association with a vehicle, comprising the steps of:

providing a gas supply capable of being removably attached to said vehicle, said gas supply providing a gas from at least one gas supply outlet;

attaching said gas supply to said vehicle;

opening at least one outlet'valve communicating with said at least one gas supply outlet to release said gas; and discharging said gas through at least one nozzle communicating with said at least one outlet valve;

wherein said gas passing through said at least one nozzle creates said flatulation sound effect.

35. The method of claim 34, wherein said providing a gas supply further comprises providing a gas storage tank.

36. The method of claim 34, wherein said opening of said outlet valve is done upon a command of an operator.

37. The method of claim 34, wherein said opening of said outlet valve is done upon a command of an operator and a controller receives said command and communicates said command to said outlet valve over at least one wire.

38. The method of claim 34, wherein said opening of said outlet valve is done upon a command of an operator and a controller receives said command and a transmitter in said controller communicates said command to a receiver communicating with said outlet valve.

39. The method of claim 34, further including the step of attaching a display to the vehicle and displaying a message in conjunction with creating said flatulation sound effect.

40. The method of claim 34, further including the step of combining two or more liquids to produce said gas stored in said gas supply.

41. A method of creating a flatulation sound effect in association with a vehicle, comprising the steps of:

providing two liquid chambers capable of storing two liquids and capable of being removably attached to said vehicle;

attaching said two liquid chambers to said vehicle;

opening two liquid valves communicating with said two liquid chambers to release a quantity of said two liquids into at least one nozzle, with said two liquids forming a gas when combined; and discharging said gas through said at least one nozzle communicating with said two liquid valves;

wherein said gas passing through said at least one nozzle creates said flatulation sound effect.

42. The method of claim 41, further comprising the step of mixing said two liquids in a mixing chamber positioned between and communicating with said two liquid valves and said at least one nozzle.

43. The method of claim 41, wherein said opening of said two liquid valves is done upon a command of an operator.

44. The method of claim 41, wherein said opening of said two liquid valves is done upon a command of an operator and a controller receives said command and communicates said command to said two liquid valves over at least one wire.

45. The method of claim 41, wherein said opening of said two liquid valves is done upon a command of an operator and a controller receives said command and a transmitter in said controller communicates said command to receivers communicating with said two liquid valves.

46. The method of claim 41, further including the step of attaching a display to the vehicle and displaying a message in conjunction with creating said flatulation sound effect.

* * * * *